US008366983B2

(12) United States Patent
Lane et al.

(10) Patent No.: US 8,366,983 B2
(45) Date of Patent: Feb. 5, 2013

(54) METHOD OF MANUFACTURING A THERMAL INSULATION ARTICLE

(75) Inventors: Jay E. Lane, Mooresville, IN (US); Gary B. Merrill, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 862 days.

(21) Appl. No.: 12/177,623

(22) Filed: Jul. 22, 2008

(65) Prior Publication Data

US 2010/0019412 A1 Jan. 28, 2010

(51) Int. Cl.
*B28B 7/30* (2006.01)

(52) U.S. Cl. ..... 264/313

(58) Field of Classification Search ..... 156/245, 156/89.11, 153, 154, 304.3, 305; 264/313, 264/314, 317
See application file for complete search history.

(56) References Cited

U.S. PATENT DOCUMENTS

| | | | | |
|---|---|---|---|---|
| 2,999,780 | A * | 9/1961 | Perrault | 264/311 |
| 6,197,424 | B1 | 3/2001 | Morrison et al. | |
| 6,670,046 | B1 | 12/2003 | Xia | |
| 6,746,755 | B2 | 6/2004 | Morrison et al. | |
| 7,198,860 | B2 | 4/2007 | Vance | |
| 7,311,790 | B2 * | 12/2007 | Morrison et al. | 156/89.11 |
| 7,351,364 | B2 | 4/2008 | Morrison et al. | |
| 2005/0167878 | A1 | 8/2005 | Morrison et al. | |
| 2006/0019807 | A1 | 1/2006 | Husted et al. | |

* cited by examiner

*Primary Examiner* — Khanh P Nguyen
*Assistant Examiner* — Vishal I Patel

(57) ABSTRACT

A method of manufacturing a thermal insulation article may include positioning, between opposing mold walls, a first layer comprising a ceramic matrix composite (CMC) material and a second layer comprising a plurality of tiles. The method may further include moving the opposing mold walls together to compress together the first and second layers, and curing the compressed together first and second layers to produce the thermal insulation article.

18 Claims, 8 Drawing Sheets

METHOD OF MANUFACTURING A THERMAL INSULATION ARTICLE

FIELD OF THE INVENTION

The present invention relates to the field of manufacturing, and, more particularly, to the manufacturing of composite materials, such as for thermal insulation.

BACKGROUND OF THE INVENTION

A metallic combustion turbine engine component is typically exposed to a gas temperature that can approach or exceed the safe operating temperature of the component. Coating a component of a metallic combustion turbine engine is a widely used technique for protecting the component from high temperatures. In particular, a common approach to coating a component involves coating the component with a ceramic thermal barrier coating.

To improve efficiency, the firing temperature of a metallic combustion turbine engine continues to be increased. One particular approach to protect a component in an application where the temperature may exceed the safe operating range is to use a ceramic matrix composite (CMC) material.

U.S. Pat. No. 6,197,424, to Morrison et al. and assigned to the assignee of the present invention discloses a turbine engine component fabricated from CMC material and covered by a layer of dimensionally stable, abradable, ceramic insulating material, commonly referred as friable grade insulation (FGI).

Current methods of coating a turbine engine component include the manufacture of an FGI shell. The FGI shell is then used as a tooling substrate onto which CMC is applied, and then thermally treated to form a hybrid CMC article. Typically, in this process, the FGI is cast as a shell within a tool, then dried, removed from the tool, and then partially fired resulting in a structure that can be used as a forming tool onto which CMC can be applied and processed.

Typically, in this process, the FGI is cast to a thickness in excess of the end product and then after the CMC has been applied and processed, the FGI is typically machined to form the final desired thickness. The current process typically requires a single piece FGI casting onto which the CMC will be applied and then fired. This process can be costly, especially if the internal geometry is not a simple cylinder, or is a complex shape.

U.S. Pat. No. 7,311,790 to Morrison et al. and assigned to the assignee of the present invention discloses a ceramic or FGI tile being affixed on a mold or substrate that is formed to define a shape for a passageway. After tiles are affixed to the mold, an outside surface of the tiles is machined to achieve the desired thickness. A CMC layer is then formed over the FGI tiles, the mold is removed, and an inside surface of the tiles is machined to achieve the desired thickness. Gaps between each FGI tile may be left unfilled to accommodate thermal expansion, or they may be filled with a filler material. Nevertheless, further improvements are desirable.

SUMMARY OF THE INVENTION

In view of the foregoing background, it is therefore an object of the present invention to provide a more efficient and reliable method of making a thermal insulation article.

This and further objects, features, and advantages in accordance with the present invention are provided by method of manufacturing a thermal insulation article including positioning, between opposing mold walls, a first layer comprising a CMC material and a second layer comprising a plurality of tiles. The method may further include moving the opposing mold walls together to compress together the first and second layers, for example. The method may further include curing the compressed together first and second layers to produce the thermal insulation article. Accordingly, the method provides a low-cost and reliable method of making the thermal insulation article.

Moreover, moving the opposing mold walls may include moving an expandable inner mold wall toward a stationary outer mold wall. The expandable inner mold wall may advantageously include an inflatable bladder, for example.

Additionally, positioning may include positioning the first and second layers so that the plurality of tiles includes a plurality of arcuate tiles arranged in overlapping fashion, for example. The first and second layers may also be positioned so that the plurality of tiles includes a plurality of tiles with gaps therebetween. For example, positioning may include positioning the first and second layers so that the plurality of tiles includes a plurality of tiles circumferentially spaced, for example.

The CMC material may be forced into the gaps upon moving the opposing mold walls together, for example. Alternatively, the method may further include filling the gaps with a refractory material after curing the compressed first and second layers. The mold walls may be removed after curing. The plurality of tiles may include a plurality of friable grade insulative tiles, for example.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to indicate similar elements in alternative embodiments.

Figure 1:
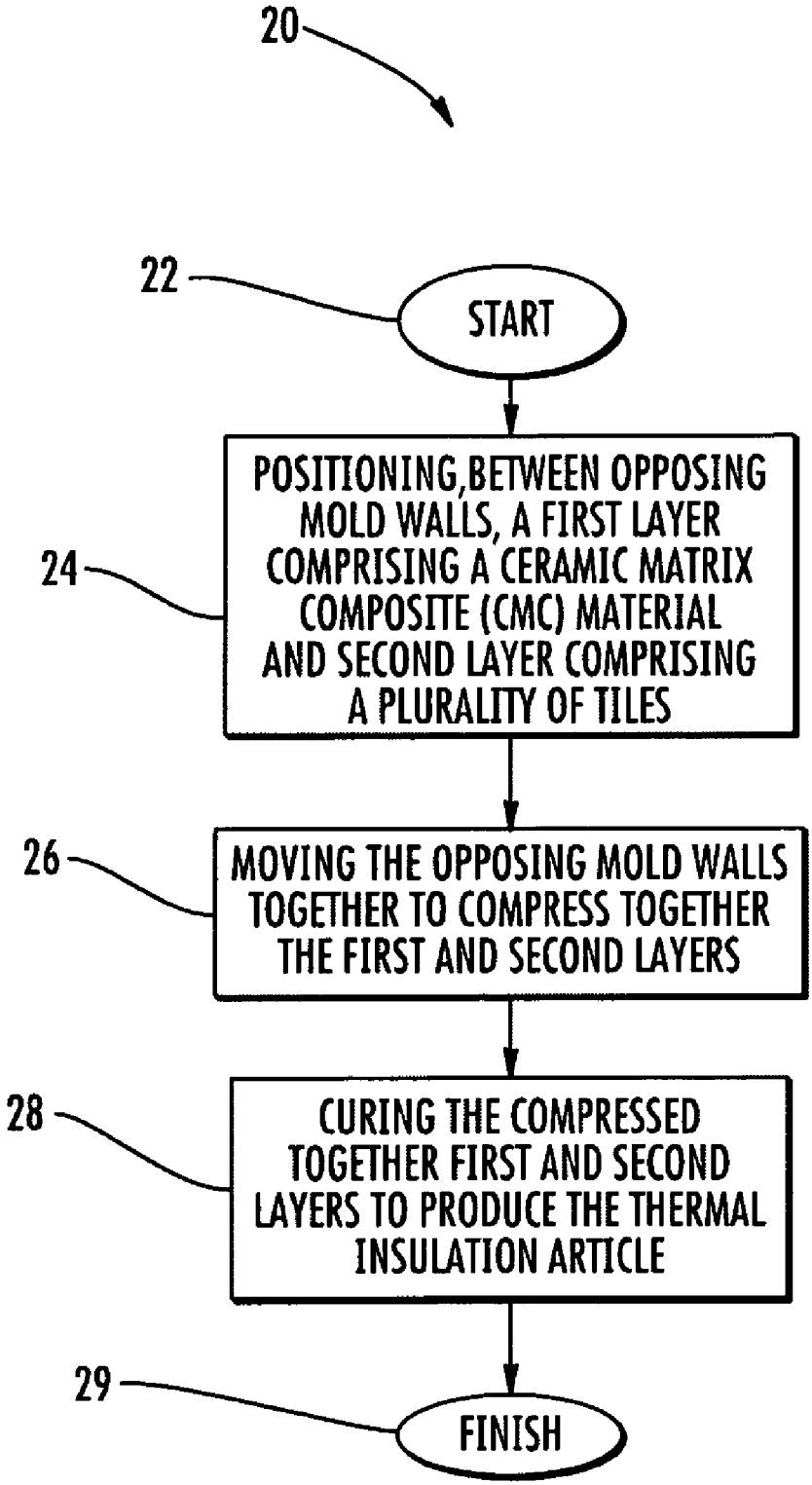
FIG. 1 is a flowchart illustrating a method of manufacturing a thermal insulation article in accordance with the present invention.

Referring initially to the flowchart 20 of FIG. 1, beginning at Block 22, a method of a manufacturing a thermal insulation article includes at Block 24 positioning, between opposing mold walls, a first layer comprising a ceramic matrix composite (CMC) material and a second layer comprising a plurality of tiles. The method further includes, at Block 26, moving the opposing mold walls together to compress together the first and second layers. The compressed first and second layers are cured at Block 28 compressing together the first and second layers to produce the thermal insulation article before ending at Block 29.

Figure 2:
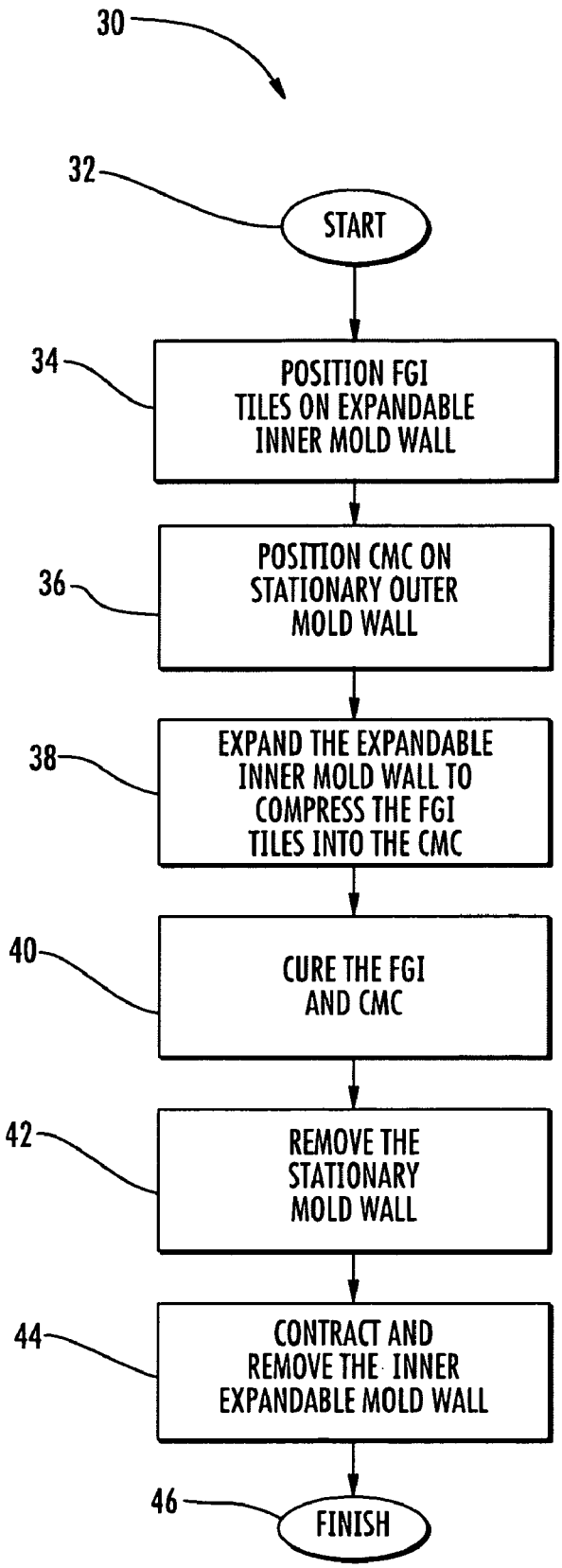
FIG. 2 is a more detailed flowchart illustrating the method of FIG. 1
Figure 3:
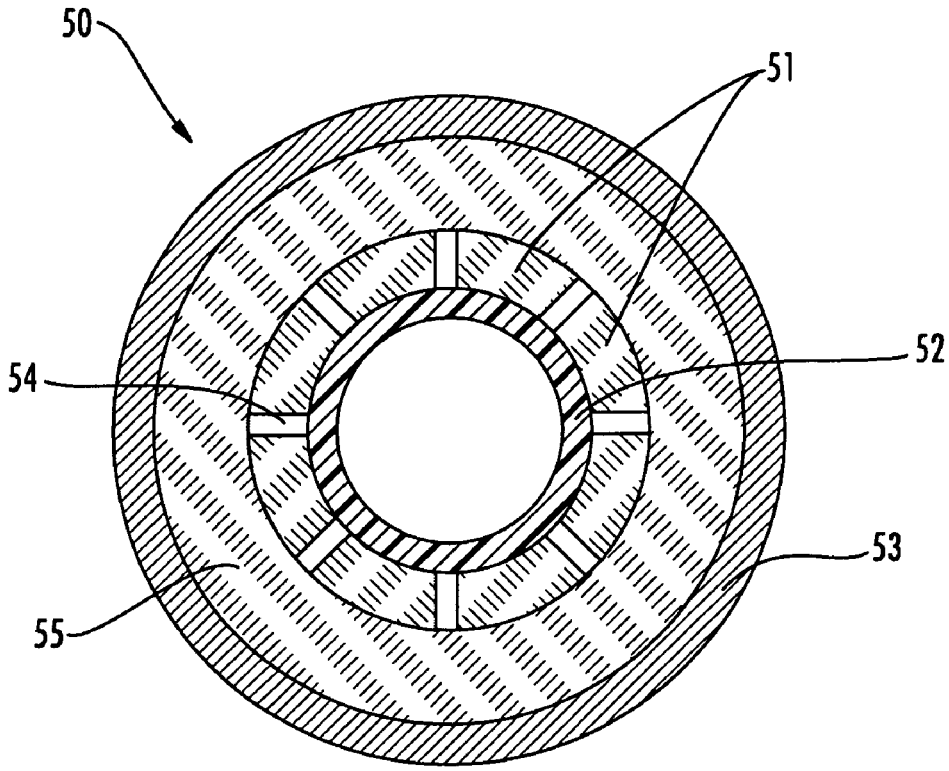
FIG. 3 is a schematic cross-sectional view of the thermal insulation article manufactured using the method of FIG. 2 prior to expanding the expandable inner mold wall.
Figure 4:
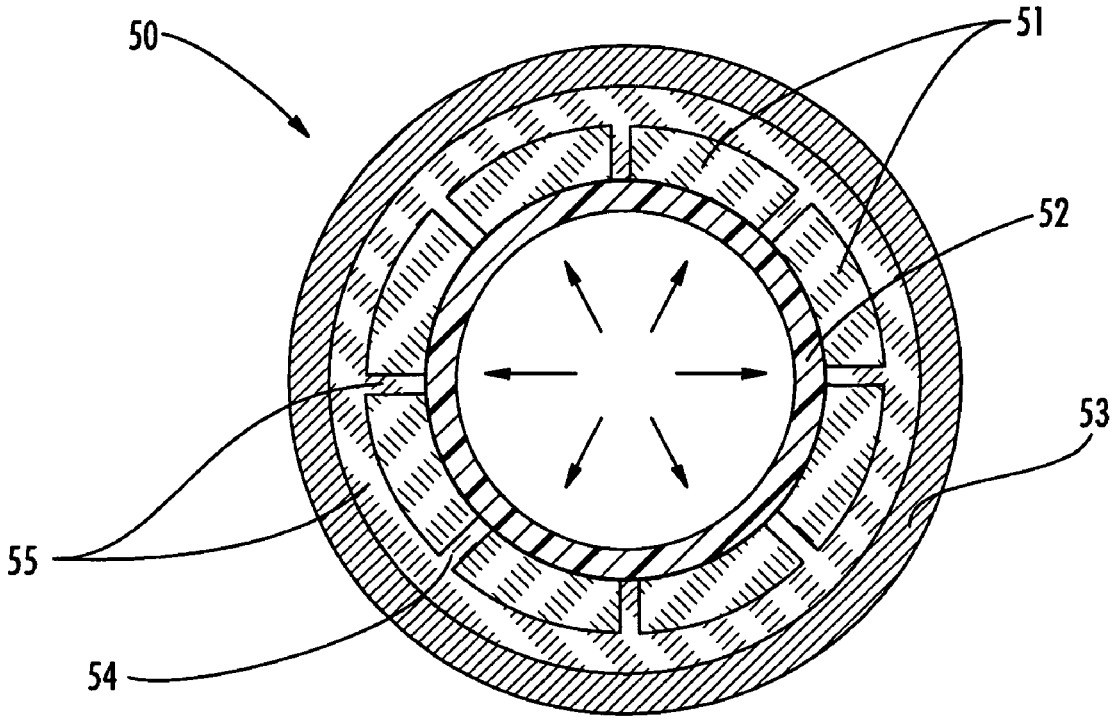
FIG. 4 is a schematic cross-sectional view of the thermal insulation article of FIG. 3 after expanding the expandable inner mold wall.
Figure 5:
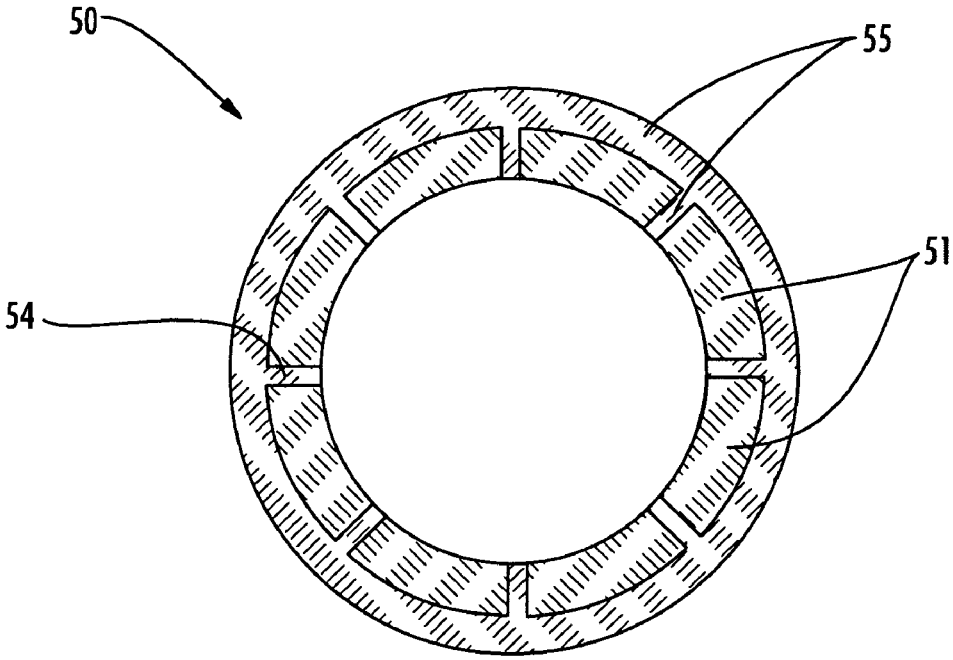
FIG. 5 is a schematic cross-sectional view of the thermal insulation article of FIG. 4 after curing and removing the mold walls.

Referring now additionally to the more detailed flowchart 30 of FIG. 2, and the first series of schematic cross-sectional views of FIGS. 3-5, further details are now explained. Beginning at Block 32, the method of manufacturing a thermal insulation article 50 includes circumferentially positioning, at Block 34, a second layer of friable grade insulative (FGI) tiles 51 in side-by-side relation onto an expandable inner mold wall 52 with gaps 54 therebetween as seen in FIG. 3. Other insulative materials may be used, as will be appreciated by those skilled in the art.

Circumferentially positioning the FGI tiles 51 may include attaching them to the expandable inner mold 52 wall via a perishable adhesive, for example, that degrades during the manufacturing process or during curing. The FGI tiles 51 may advantageously be different shapes and sizes to accommodate different applications, as will be appreciated by those skilled in the art, and may be combined to form a complex shape that would otherwise be difficult to cast as a single piece, or control during processing. Still further, the FGI tiles 51 provide improved bond strength and the ability to change the thickness of FGI tile or shape in any given area, as may be required, and thus, the FGI machining costs are reduced. Additionally, the manufacture of FGI tiles 51 is less expensive than a more-complex shape single-structure FGI body.

Circumferential placement of the FGI tiles 51 on the expandable inner mold wall 52 illustratively results in a gap 54 between adjacent tiles. The gap 54 can be controlled by accurate placement of the tiles onto the surface of the expandable inner mold wall 52. The gap 54 also advantageously can be used to form a column-like structure in the FGI tiles 51, which can be beneficial in thermal stress situations, as will be appreciated by those skilled in the art.

The stationary outer mold wall 53 illustratively opposes the expandable inner mold wall 52 and is a stationary outer containment wall. As will be appreciated by those skilled in the art, in other embodiments the stationary outer mold wall 53 can be movable toward the opposing expandable inner mold wall 52. In other words, the inner mold 52 wall may be stationary, and the outer mold wall 53 may be moveable.

A first layer illustratively includes a ceramic matrix composite material (CMC) 55 positioned between the FGI tiles 51 and the stationary outer mold wall 53 (Block 36). The CMC material 55 is bound by the stationary outer mold wall 53, as illustrated in FIGS. 3 and 4, for example. As will be appreciated by those skilled in the art, the CMC material 55 can be positioned on the outer mold wall 53, as may be the case when the outer mold wall is an outer turbine combustor liner or basket, or a transition duct, for example. In other words, the outer mold wall 53 and/or inner mold wall 52 can be part of an overall device, and need not be a mold tool as will be appreciated by those of skill in the art. The CMC material 55 is advantageously pre-preg or in a partially cured state to facilitate bonding. In some embodiments, not shown, the CMC material 55 may be cured, and additional adhesive may be used to facilitate bonding between the CMC material and the FGI tiles 51.

After positioning the FGI tiles 51 and the CMC material 55, the expandable inner mold wall 52 is expanded outwardly, at Block 38, to compress the FGI tiles 51 into the surface of the CMC material 55 as seen in FIG. 4. As will be appreciated by those skilled in the art, the inner mold wall 52 can be, for example, an inflatable bladder, and other expandable devices may be used. Applying the FGI tiles 51 to the CMC material 55 using the expandable inner mold wall 52 advantageously provides a more efficient compaction of the CMC material during the lay-up resulting in improved CMC material microstructure.

In the illustrated embodiment, the CMC material 55 is forced into each gap 54 after expanding the inner mold wall 52, as illustrated in FIGS. 4 and 5, for example. The combined CMC material 55 and FGI tiles 51 are then cured (Block 40) using conventional methods that will be apparent to those skilled in the art.

After curing, the stationary outer mold wall 53 is removed (Block 42). The expandable inner mold wall 52 is contracted and likewise removed (Block 44) to form the thermal insulation article 50 before ending at Block 46. Advantageously, the method provides an easier manufacturing path for complex shapes such as transition ducts, as noted above.

Figure 6:
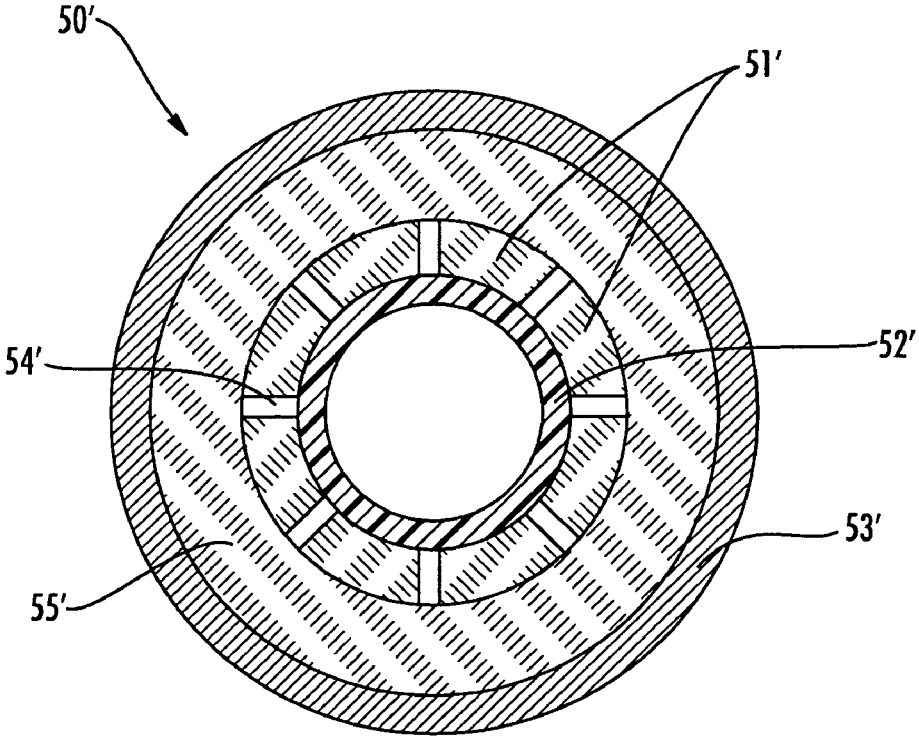
FIG. 6 is a schematic cross-sectional view of another embodiment of the thermal insulation article manufactured using the method of FIG. 2 prior to expanding the expandable inner mold wall.
Figure 7:
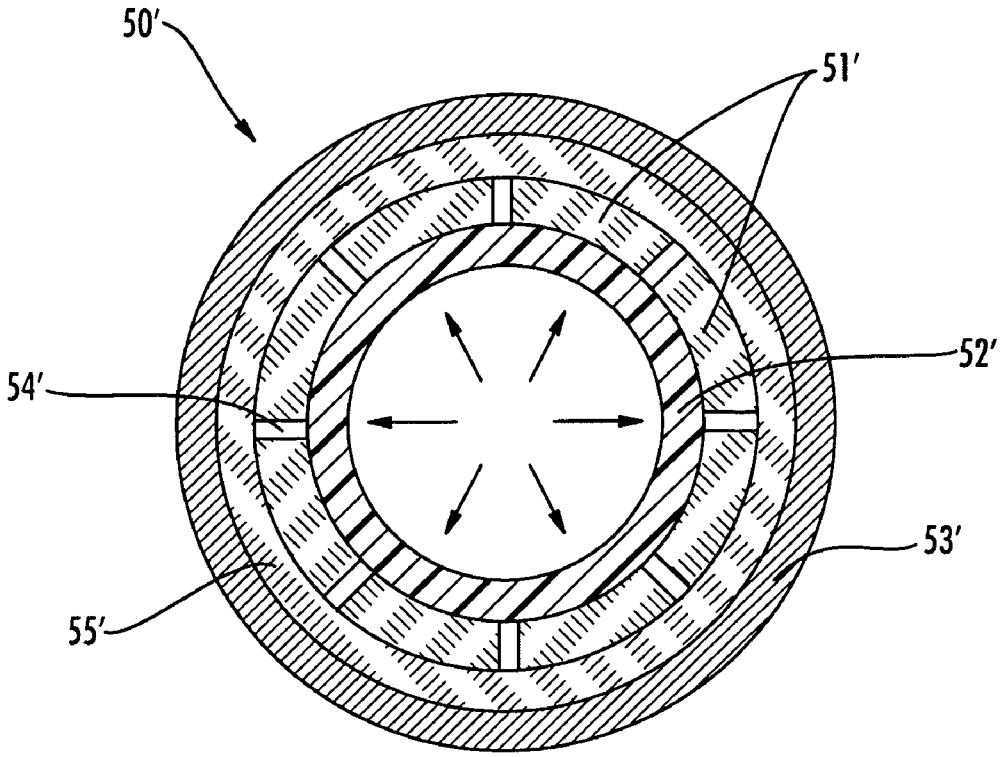
FIG. 7 is a schematic cross-sectional view of the thermal insulation article of FIG. 6 after expanding the expandable inner mold wall.
Figure 8:
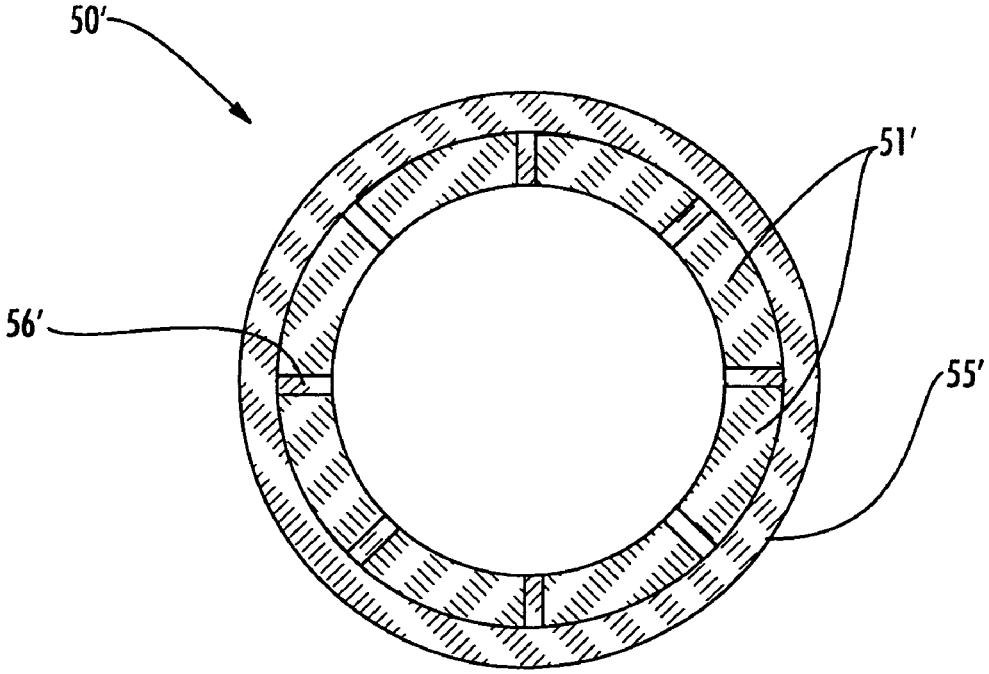
FIG. 8 is a schematic cross-sectional view of the thermal insulation article of FIG. 7 after curing and removing the mold walls.

Referring now to FIGS. 6-8, in another embodiment, the CMC material 55' is not initially in each gap 54' (FIG. 6) and is not forced into each gap upon expansion of the expandable inner mold wall 52' (FIG. 7). A barrier or other structure, not shown, prevents the CMC material 55' from being forced into the gaps 54'. The combined CMC material 55' and FGI tiles 51' are then cured.

After curing, the stationary outer mold wall 53' is removed. The expandable inner mold wall 52' is contracted and likewise removed. Each gap 54' is filled after processing or curing with a refractory material 56' (FIG. 8). The refractory material 56' advantageously protects the CMC material 55' from thermal degradation, as will be appreciated by those skilled in the art.

Figure 9:
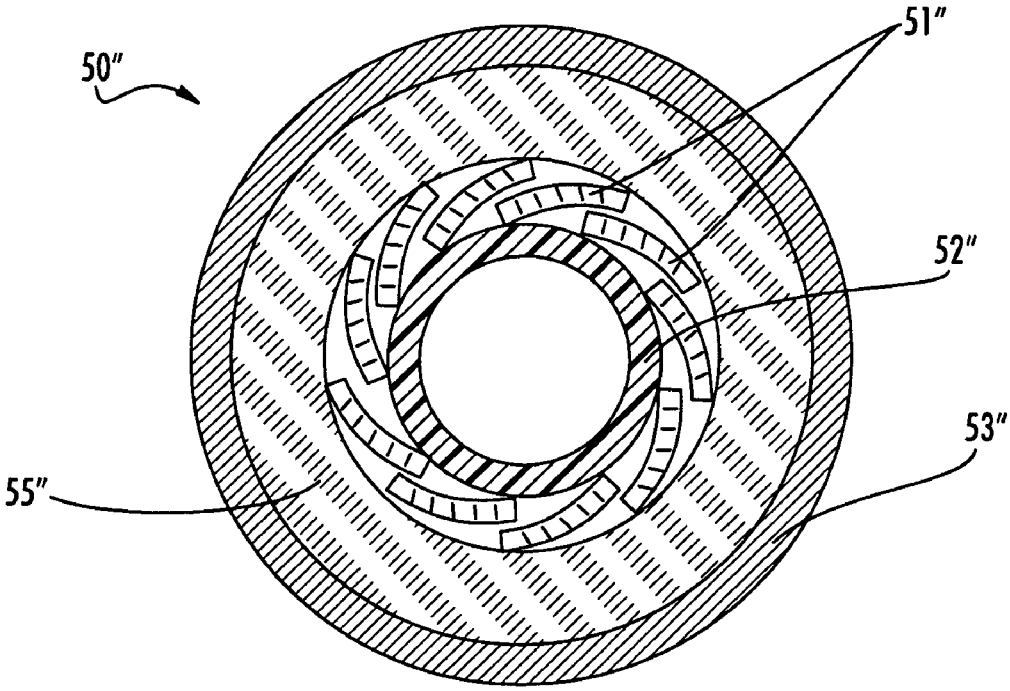
FIG. 9 is a schematic cross-sectional view of another embodiment of the thermal insulation article manufactured using the method of FIG. 2 prior to expanding the expandable inner mold wall.
Figure 10:
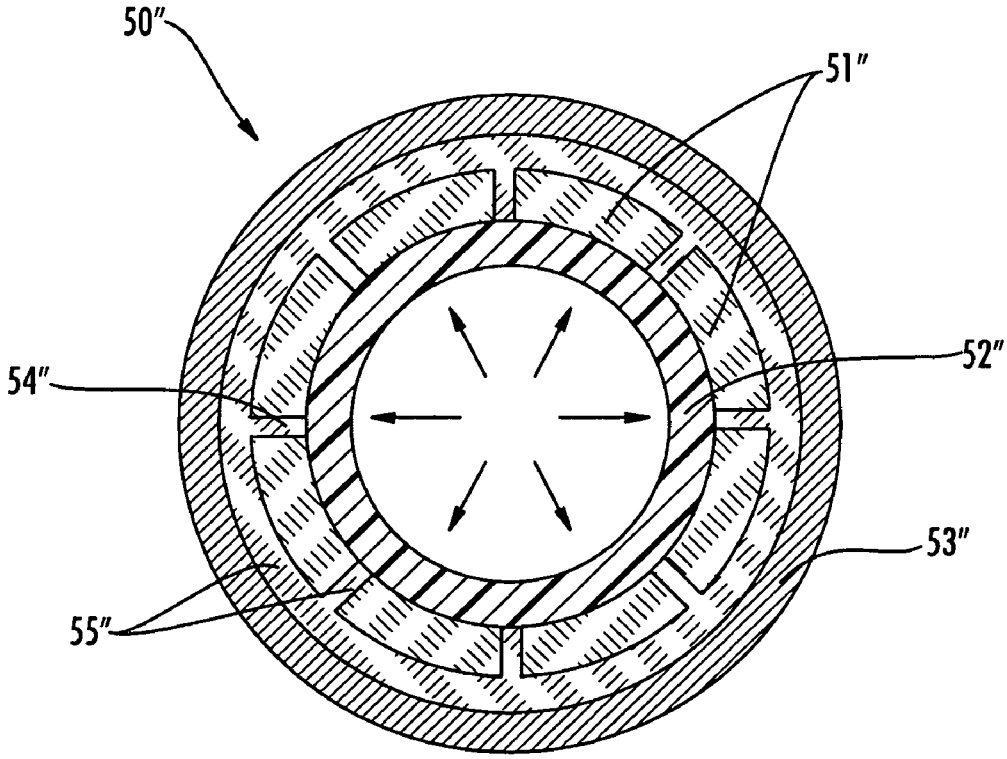
FIG. 10 is a schematic cross-sectional view of the thermal insulation article of FIG. 9 after expanding the expandable inner mold wall.
Figure 11:
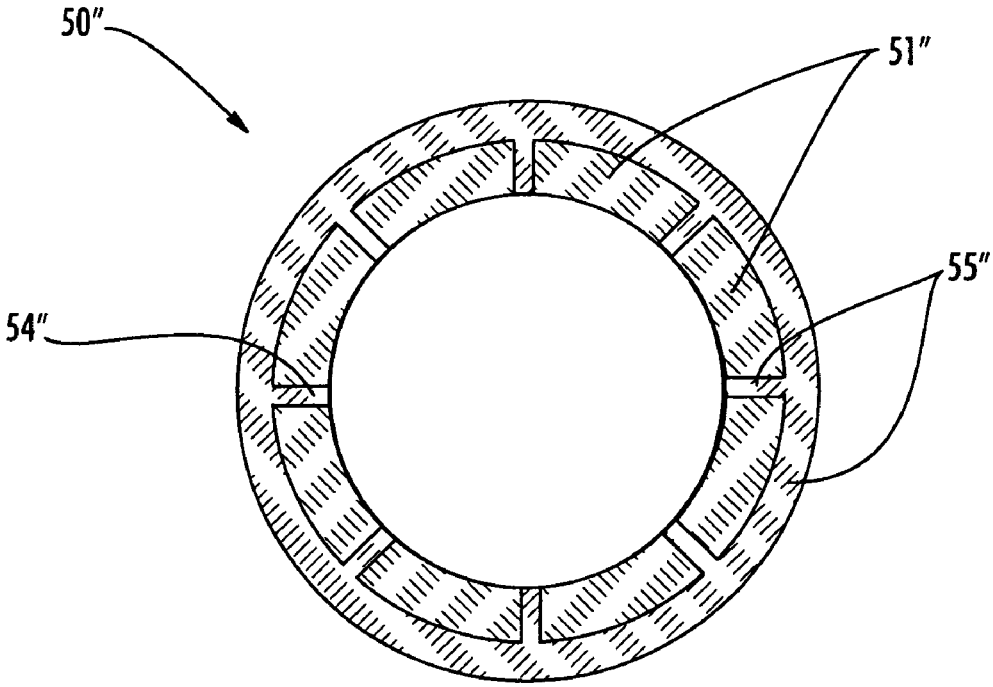
FIG. 11 is a schematic cross-sectional view of the thermal insulation article of FIG. 10 after curing and removing the mold walls.

Referring now to FIGS. 9-11, another embodiment illustratively includes arcuate FGI tiles 51" that are arranged in an overlapping fashion (i.e. without a gap 54" between each tile)

(FIG. 9). Using arcuate FGI tiles 51" advantageously allows for the placement of the arcuate FGI tiles onto the expandable inner mold wall 52".

The expansion of the expandable inner mold wall 52", relocates the arcuate FGI tiles 51" to the correct position compressed together with the CMC material 55" (FIG. 10) prior to the processing or curing. The expansion of the expandable inner mold wall 52" also results in the arcuate FGI tiles 51" being positioned in side-by-side relation and having a gap 54" between adjacent tiles. As illustrated in FIGS. 10 and 11, and similar to the embodiment illustrated in FIGS. 3-5, the CMC material 55" is forced into each gap 54" upon expansion of the inner mold wall 52".

The arcuate FGI tiles 51" and the CMC material 55" are then processed or cured with the CMC material 55" in the gaps 54". The expandable inner mold wall 52" is contracted and then removed, and the stationary outer mold wall 53" is likewise removed, as illustrated in FIG. 11.

Figure 12:
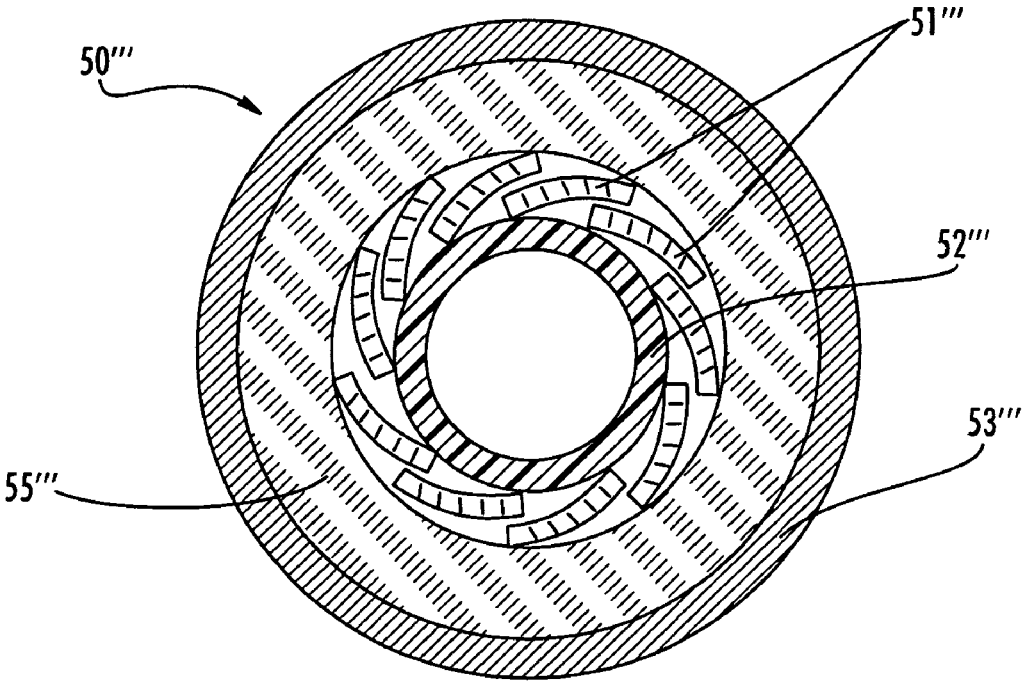
FIG. 12 is a schematic cross-sectional view of another embodiment of the thermal insulation article manufactured using the method of FIG. 2 prior to expanding the expandable inner mold wall.
Figure 13:
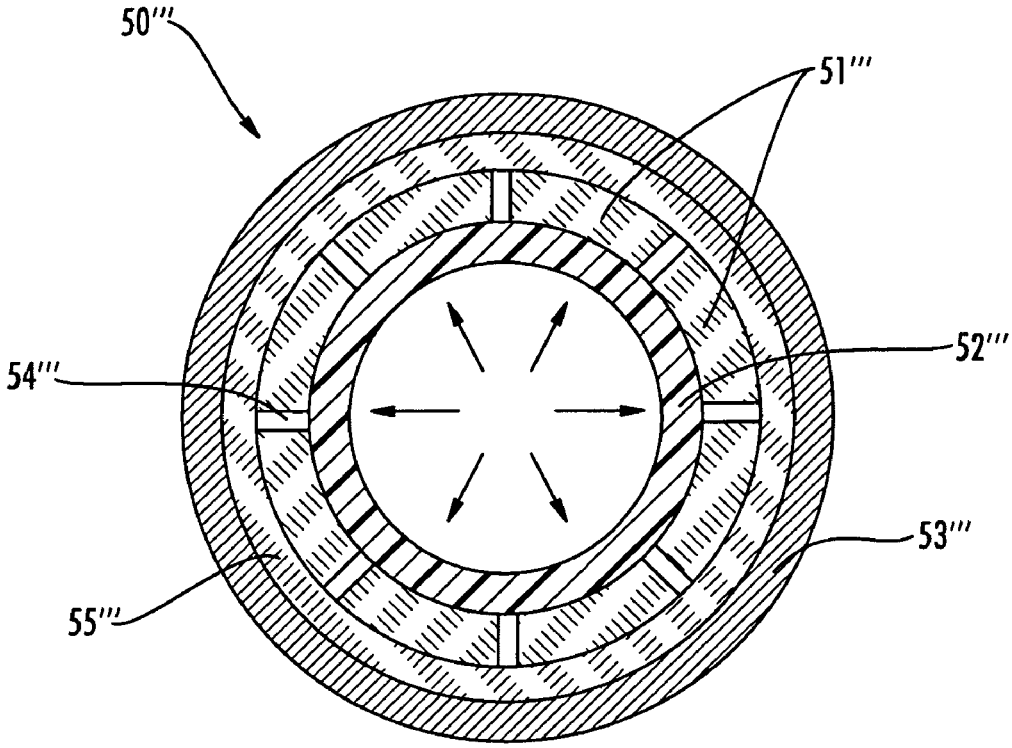
FIG. 13 is a schematic cross-sectional view of the thermal insulation article of FIG. 12 after expanding the expandable inner mold wall.
Figure 14:
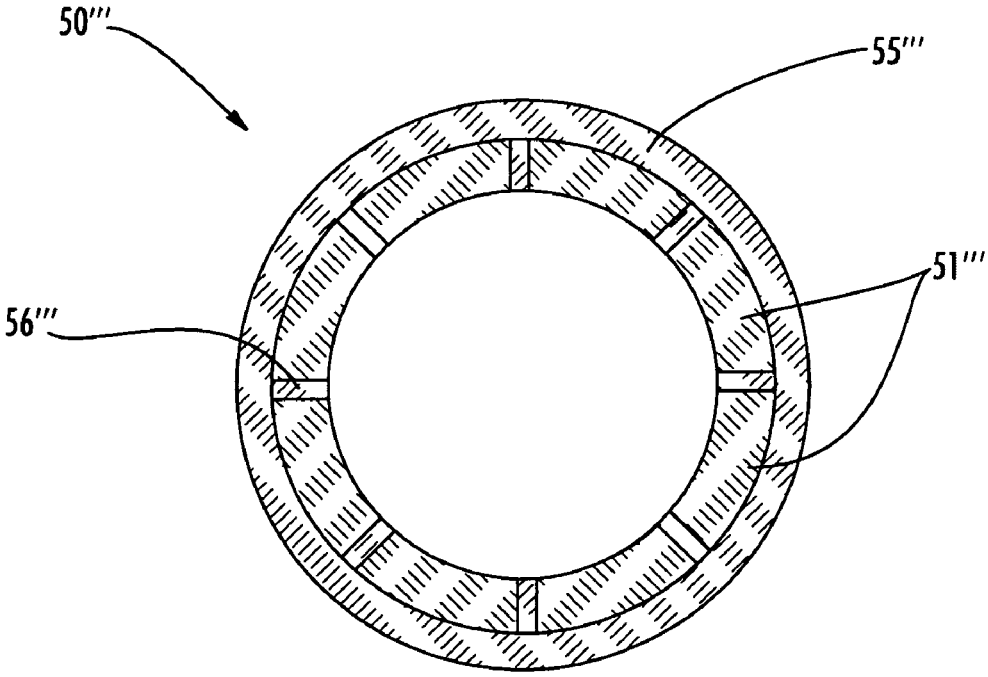
FIG. 14 is a schematic cross-sectional view of the thermal insulation article of FIG. 13 after curing and removing the mold walls.

Referring now to FIGS. 12-14, in another embodiment, and similar to the embodiment illustrated in FIGS. 6-8, the CMC material 55'" is not initially in each gap 54'" (FIG. 12) and is not forced into each gap upon expansion of the expandable inner mold wall 52'" (FIG. 13). A barrier or other structure, not shown, prevents the CMC material 55'" from being forced into the gaps 54'". The combined CMC material 55'" and arcuate FGI tiles 51'" with gaps 54'" therebetween are then cured.

After curing, the stationary outer mold wall 53'" is removed. The expandable inner mold wall 52'" is contracted and likewise removed. Each gap 54'" is filled post-processing or post-curing with a refractory material 56'" (FIG. 14). The refractory material 56'" advantageously protects the CMC material 55'" from thermal degradation, as will be appreciated by those skilled in the art.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A method of manufacturing a thermal insulation article comprising:

positioning, between opposing mold walls, a first layer comprising a ceramic matrix composite (CMC) material and a second layer comprising a plurality of tiles;

moving the opposing mold walls together to compress together the first and second layers to control pressure and placement of the second layer upon the first layer so as to set spacing between adjacent tiles; and curing the compressed together first and second layers to produce the thermal insulation article with the set spacing between adjacent tiles.

2. The method according to claim 1 wherein moving the opposing mold walls comprises moving an expandable inner mold wall toward a stationary outer mold wall.

3. The method according to claim 2 wherein the expandable inner mold wall comprises an inflatable bladder.

4. The method according to claim 1 wherein positioning comprises positioning the first and second layers so that the plurality of tiles comprises a plurality of arcuate tiles arranged in overlapping fashion.

5. The method according to claim 1 wherein positioning comprises positioning the first and second layers so that the plurality of tiles comprises a plurality of tiles arranged with gaps therebetween.

6. The method according to claim 5 wherein positioning further comprises positioning the first and second layers so that the plurality of tiles comprises a plurality of tiles circumferentially spaced.

7. The method according to claim 5 wherein the CMC material is forced into the gaps upon moving the opposing mold walls together.

8. The method according to claim 5 further comprising filling the gaps with a refractory material after curing the compressed together first and second layers.

9. The method according to claim 1 further comprising removing the mold walls after curing the compressed together first and second layers.

10. The method according to claim 1 wherein the plurality of tiles comprises a plurality of friable grade insulative tiles.

11. A method of manufacturing a thermal insulation article comprising:

positioning, between an expandable inner mold wall and an opposing stationary outer mold wall, a first layer comprising a ceramic matrix composite (CMC) material and a second layer comprising a plurality of friable grade insulative (FGI) tiles;

moving the first expandable mold wall toward the second mold wall to compress together the first and second layers to control pressure and placement of the second layer upon the first layer so as to set spacing between adjacent tiles; and curing the compressed together first and second layers to produce the thermal insulation article with the set spacing between adjacent tiles.

12. The method according to claim 11 wherein positioning comprises positioning the first and second layers so that the plurality of FGI tiles comprises a plurality of arcuate FGI tiles arranged in overlapping fashion.

13. The method according to claim 11 wherein positioning comprises positioning the first and second layers so that the plurality of FGI tiles comprises a plurality of FGI tiles arranged with gaps therebetween.

14. The method according to claim 13 wherein positioning further comprises positioning the first and second layers so that the plurality of FGI tiles comprises a plurality of FGI tiles circumferentially spaced.

15. The method according to claim 13 wherein the CMC material is forced into the gaps upon moving the opposing mold walls together.

16. The method according to claim 13 further comprising filling the gaps with a refractory material after curing the compressed together first and second layers.

17. The method according to claim 11 further comprising removing the mold walls after curing the compressed together first and second layers.

18. The method according to claim 11 wherein the expandable inner mold wall comprises an inflatable bladder.

* * * * *